US010071885B2

(12) United States Patent
O'Brien et al.

(10) Patent No.: US 10,071,885 B2
(45) Date of Patent: Sep. 11, 2018

(54) VACUUM LIFT ATTACHMENT

(71) Applicants: Gerard O'Brien, Sumner Park BC (AU); Matthew Graeme Dridan, Sumner Park BC (AU)

(72) Inventors: Gerard O'Brien, Sumner Park BC (AU); Matthew Graeme Dridan, Sumner Park BC (AU)

( * ) Notice: Subject to any disclaimer, the term of this patent is extended or adjusted under 35 U.S.C. 154(b) by 20 days.

(21) Appl. No.: 15/247,380

(22) Filed: Aug. 25, 2016

(65) Prior Publication Data

US 2017/0057794 A1 Mar. 2, 2017

(30) Foreign Application Priority Data

Aug. 26, 2015 (AU) ..... 2015903451

(51) Int. Cl.
*B66C 1/02* (2006.01)
*B25B 11/00* (2006.01)
(Continued)

(52) U.S. Cl.
CPC ..... *B66C 1/0256* (2013.01); *B25B 11/005* (2013.01); *B66C 1/02* (2013.01);
(Continued)

(58) Field of Classification Search
CPC ..... B66C 1/0256; B66C 1/02; B66C 1/0218
(Continued)

(56) References Cited

U.S. PATENT DOCUMENTS 2,578,220 A 12/1951 Billner
3,351,370 A 11/1967 Olson
(Continued)

FOREIGN PATENT DOCUMENTS

AU 2010202108 A1 9/2010
AU 2011250782 A1 5/2012
(Continued)

OTHER PUBLICATIONS

EP search report for EP application 16185639.8 dated May 23, 2017, 15 pages.

*Primary Examiner* — Paul T Chin
(74) *Attorney, Agent, or Firm* — Ohlandt, Greeley, Ruggiero & Perle, L.L.P.

(57) ABSTRACT

A vacuum lift attachment (10) for a hydraulic work machine, the hydraulic work machine including a control station, a lift arm to which the hydraulic work attachment can be coupled, an auxiliary hydraulic system for operating a coupled hydraulic work attachment and an auxiliary hydraulic actuator in the control station that upon actuation by an operator causes an auxiliary hydraulic control signal to generate. The vacuum lift attachment comprises a body (12) having an upper end (13) that is adapted to be coupled to the lift arm of the hydraulic work machine and for hydraulic fluid connection to the auxiliary hydraulic system of the hydraulic work machine, a vacuum pad (20) mounted to the lower end of the body (10), a hydraulic vacuum pump (34) fluidly connected to the auxiliary hydraulic system and an electronic controller (26) that is configured to receive an auxiliary hydraulic control signal and convert the auxiliary hydraulic control signal to an electronic signal for electronic control of the hydraulic vacuum pump (20) by an operator actuating the auxiliary hydraulic actuator in the control station.

20 Claims, 5 Drawing Sheets

(51) Int. Cl.

| | |
|---|---|
| ***B66C 23/44*** | (2006.01) |
| ***E02F 3/36*** | (2006.01) |
| ***E01C 19/52*** | (2006.01) |
| ***E02F 3/96*** | (2006.01) |

(52) U.S. Cl.
CPC ..... *B66C 1/0218* (2013.01); *B66C 23/44* (2013.01); *E01C 19/524* (2013.01); *E02F 3/3654* (2013.01); *E02F 3/963* (2013.01)

(58) Field of Classification Search
USPC ..... 294/183, 185; 901/40; 414/737, 627
See application file for complete search history.

(56) References Cited

U.S. PATENT DOCUMENTS

| | | | | |
|---|---|---|---|---|
| 3,467,430 | A | 9/1969 | Lowe | |
| 4,641,007 | A | 2/1987 | Lach | |
| 4,750,768 | A * | 6/1988 | Kumar | B66C 1/0212 294/185 |
| 4,787,812 | A | 11/1988 | Göpfert | |
| 4,994,240 | A * | 2/1991 | Hayashi | B25J 15/0616 294/185 |
| 5,297,830 | A * | 3/1994 | Hoke | B66C 1/025 294/65 |
| 5,376,158 | A * | 12/1994 | Shetterly | C03B 23/03 65/106 |
| 5,906,532 | A * | 5/1999 | Nakajima | B24B 37/30 451/285 |
| 6,279,225 | B1 * | 8/2001 | Martin | H05K 13/0404 29/740 |
| 6,691,435 | B1 | 2/2004 | Schultz et al. | |
| 7,400,058 | B1 | 7/2008 | Wayne et al. | |
| 8,528,955 | B2 * | 9/2013 | Robinson | B25J 11/0045 294/185 |
| 2003/0194305 | A1 | 10/2003 | Opitz | |
| 2009/0044983 | A1 * | 2/2009 | Gobright, IV | B23D 59/006 175/203 |
| 2010/0183415 | A1 | 7/2010 | Solomon et al. | |
| 2014/0054911 | A1 | 2/2014 | Solomon | |
| 2015/0292277 | A1 * | 10/2015 | Solomon | E21B 19/14 175/57 |
| 2015/0375401 | A1 * | 12/2015 | Dunkmann | B65G 47/91 700/228 |

FOREIGN PATENT DOCUMENTS

| | | | |
|---|---|---|---|
| AU | 2012201885 | A1 | 10/2012 |
| BE | 1019038 | A3 | 2/2012 |
| DE | 29707261 | U1 | 6/1997 |
| DE | 202008015603 | U1 | 2/2009 |
| DE | 202013001823 | U1 | 3/2013 |
| DE | 102013003209 | A1 | 8/2014 |
| EP | 0 176 496 | A1 | 4/1986 |
| EP | 0 312 696 | A1 | 4/1989 |
| KR | 20140082373 | A | 7/2014 |
| WO | 9512541 | A1 | 5/1995 |

* cited by examiner

VACUUM LIFT ATTACHMENT

FIELD

The present disclosure relates to a vacuum lift attachment for a hydraulic work machine such as an excavator.

BACKGROUND

The use of vacuum to lift objects is well known. Vacuum lift attachments for heavy machinery such as excavators are widely used for lifting heavy objects in the construction industry such as concrete, granite slabs, metal sheet and the like. Vacuum lift attachments are also used to lift pipes in pipeline construction. The vacuum lift attachments are fully self-contained with an on-board diesel engine with fuel tank to power an on-board vacuum pump with a vacuum pad or shoe. They are controlled either by a battery operated remote control or a hardwired control fitted inside an excavator or other work machine cabin.

The vacuum lift attachments have a yoke for fitting to an end of an excavator stick. Generally the yokes are manufactured for fitting to a specific excavator size, although multi excavator yokes are available.

Generally a hydraulic rotator is mounted between the yoke and the lift attachment for rotation of the attachment. The rotator is powered by an excavator's auxiliary hydraulic system.

It is considered desirable in the construction, pipe-laying, and related industries to reduce costs and increase safety. To this end, there have been many developments and improvements in the vacuum attachment lifting industry with respect to improving on the existing yoke design, safety features, remote control features, shoe/pad design, engine/pump designs and the like.

In the present specification and claims the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

SUMMARY

According to a first broad aspect there is disclosed a vacuum lift attachment for a hydraulic work machine, the hydraulic work machine including a control station, a lift arm to which the hydraulic work attachment can be coupled, an auxiliary hydraulic system for operating a coupled hydraulic work attachment and an hydraulic auxiliary actuator in the control station for that causes an auxiliary hydraulic control signal to generate upon actuation of the hydraulic auxiliary actuator by an operator; characterised in that the vacuum lift attachment comprises a body having an upper end that is adapted to be coupled to the lift arm of the hydraulic work machine and for hydraulic fluid connection to the auxiliary hydraulic system of the hydraulic work machine;

a vacuum pad operatively mounted to the lower end of the body;

a hydraulic vacuum pump fluidly connected to the auxiliary hydraulic system;

an electronic controller that is configured to receive an auxiliary hydraulic control signal and convert the auxiliary hydraulic control signal to an electronic signal for electronic control of the hydraulic vacuum pump by an operator using the auxiliary actuator in the control station.

The present inventors have departed from the recognised conventions in the vacuum lifting arts and provided a vacuum lift attachment that does not require any remote or hardwired control, or self-contained diesel engine.

The work machine may be any suitable work machine having an auxiliary hydraulic system for the operation of a hydraulically driven work attachment such as hydraulic hammers, rotators, augers, drills and the like.

The work machine may be any suitable work machine that has, or can be adapted to have, an auxiliary hydraulic system, and includes excavators, backhoes, cranes and the like.

The attachment has a body having an upper end that is adapted to be coupled to the end of the lift arm of the work machine.

Suitably, the body has a pair of transverse mounting pins on the upper end that can be coupled to a quick hitch. The advantages of quick hitches to facilitate rapid exchange of work tools such as buckets on excavators and other heavy machinery is well known in the industry. Quick hitches allow work tools to be changed in a minute or less, with less man power and superior safety when compared with manually removing and loading connecting pins.

It will be appreciated that by providing a quick hitch mounting option, an excavator or other suitable work machine can quickly and easily change a conventional work attachment such as a bucket with the disclosed vacuum lift attachments. This may be particularly desirable when laying pipe over a small pipe line length, as it allows a single machine to be used for excavating, pipe lifting, pipe laying and backfilling.

The disclosed vacuum lift attachments have a vacuum pad operatively mounted to the lower end of the body. The vacuum pad may be any suitable vacuum pad depending upon the material to be lifted. Matching vacuum pads with materials to be lifted is known in the art.

By operatively mounted means that it is not strictly necessary that the body is directly coupled to the vacuum pad, provided the mounting allows for the vacuum pad to be operate as such. For example, as discussed below, a hydraulic rotator may be mounted between the body and the vacuum pad.

The disclosed vacuum lift attachment may be provided with a hydraulic rotator to allow rotation of the vacuum pad so as to align the vacuum pad prior to loading and to align a loaded pipe prior to unloading.

The use of hydraulic rotators with vacuum lift attachments is well known in the industry. The hydraulic rotators are operatively mounted to the lifting arm of the work machine where they can be connected to the auxiliary hydraulic lines.

Suitably the disclosed vacuum lift attachments have the rotator mounted between the body and the vacuum pad. This means that only the vacuum pad rotates instead of the whole vacuum lift attachment. This has advantages in that there is less overall weight for the rotator to operate, particularly when rotating the vacuum shoe in the unloaded state.

Thus there is also disclosed a vacuum lift attachment that further comprises a hydraulic rotator mounted to the lower end of the body and between the body and the vacuum pad.

It will be appreciated that such an arrangement has applications to vacuum lift attachments other than those disclosed herein.

The disclosed vacuum lift attachments include a hydraulic pump that is fluidly connected to the auxiliary hydraulic system so that the pump may be driven thereby. The vacuum pump will only operate when there is a flow of auxiliary hydraulic fluid. This provides the pump with a "vacuum on demand function". This may be compared to conventional diesel driven vacuum lift attachments in which the diesel engine is running continuously, even when vacuum is not required. This increases noise and pollution levels and is expensive to operate. Further, only operating the vacuum pump when desired can extend the service life on the vacuum pump.

The vacuum lift attachment suitably has a vacuum reservoir in fluid communication with the vacuum pad, which fluid flow is controlled by an air valve(s) operable between open and closed positons so as to apply and close supply of vacuum to the pads.

Suitably, the vacuum reservoir includes a first service reservoir and a second reserve reservoir. The reservoirs may be discrete units or may be a single unit divided into two parts. If in use, an emergency situation arises if there is a loss of vacuum when carrying a load in the event of a vacuum leak, the electronic controller (discussed below) is configured to sense the loss of vacuum and to automatically operatively connect the reserve reservoir to the vacuum pad so as to avoid or at least partially avoid further vacuum loss. This will give an operator sufficient time to safely lower and disengage the load. Suitably the reserve reservoir may be connected to the main reservoir.

Also disclosed is a vacuum work attachment that further comprises at least one vacuum reservoir in fluid communication with the vacuum pad, in which the fluid communication is controlled by at least one air valve operable between an open position in which a vacuum is applied to the vacuum pad and a closed positon in which no or reduced vacuum is applied to the vacuum pad.

Suitably, the vacuum lift attachment includes a first service reservoir and a second reserve reservoir and the second reserve vacuum reservoir is fluidly isolated from the vacuum pad when the vacuum pad is carrying a load at or above a predetermined safe vacuum level, and if the vacuum level falls below the predetermined safe vacuum level a second air valve is actuated to fluidly connect the reserve vacuum reservoir to the vacuum pad.

The vacuum lift attachment also includes an electronic controller that is configured to receive control input through the auxiliary hydraulic system in response to actuation of the auxiliary actuator such that operation of the vacuum lift attachment can be controlled using the auxiliary actuator in the control station.

The hydraulic signals from the auxiliary hydraulic system are suitably converted to electric signals by electro-hydraulic pressure switches. Such switches open or close electrical contacts when a set pressure is achieved or exceeded.

Suitably the electronic controller is a programmable logic controller (PLC).

Suitably, the electronic controller is configured to remain in a sleep mode until a hydraulic signal is detected by the controller and the controller is activated to an operative mode.

When the auxiliary hydraulic system is activated, the vacuum pump builds up a vacuum until it reaches the desired or predetermined level.

Suitably the vacuum lift attachment includes a sensor that is receptive to the vacuum detected by a vacuum gauge that produces an audio and/or visual signal that can be seen and/or heard by an operator in the control station of the work machine to indicate when the vacuum has reached the desired level.

Suitably an audio and/or visual signal is produced when the vacuum is being applied.

Thus, there is disclosed a vacuum lift attachment that further includes a vacuum sensor operatively connected to a vacuum gauge that is configured to produce an audio and/or visual signal that can be seen and/or heard by an operator in the control station of the work machine to indicate when the vacuum has reached the predetermined operating level.

In use, when the desired vacuum has been reached, an operator can place the vacuum pad in contact with an object to be lifted. Suitably the vacuum lift attachment includes a load sensor that senses when the vacuum pad has contacted the load. Suitably the sensor causes an audio and/or visual signal that can be seen and/or heard by the operator in the control station. In this case, after the signal is seen and/or heard, the operator can then proceed to apply vacuum to the object.

Suitably a further audio and/or visual signal is generated so as to confirm to the operator that vacuum is being applied. A further signal is suitably produced when there is sufficient vacuum applied to lift the object. When the object is lifted, the load sensor, if present, is deactivated such that the electronic controller knows that a load has been lifted. Suitably, the electronic controller will prevent any inadvertent activation by an operator that may release the vacuum whilst a load is being lifted.

Thus, there is disclosed a vacuum lift attachment that further includes a load sensor that is activated when the vacuum pad has contacted a load to be lifted and when activated, an audio and/or visual signal that can be seen and/or heard by the operator in the control station.

The electronic controller is configured to automatically disengage rotate mode when the load sensor is activated.

Suitably, when the vacuum is being applied to the load to be lifted, an audio and/or visual signal is generated so as to confirm to the operator that vacuum is being applied and a further signal is generated when there is sufficient vacuum applied to lift the object.

Suitably that when the load is lifted, the load sensor is deactivated and the electronic controller is configured to receive a signal that the load sensor is deactivated and prevents inadvertent operator release of the applied vacuum.

The vacuum lift attachment suitably includes a bidirectional valve system for splitting the auxiliary hydraulic fluid flow into a first stream that drives and controls the vacuum pump and a second stream for operation of the hydraulic rotator. In this case, the controller is suitably configured to operate either in a vacuum control mode that responds to auxiliary hydraulic signals from the auxiliary actuator or a rotate mode that responds to auxiliary hydraulic signals from the auxiliary actuator. In this way an operator can control both functions using the work machines existing auxiliary hydraulic controls.

Thus there is disclosed a vacuum work attachment that when the electronic controller is on the operative mode, rather than a sleep mode, the electronic controller is further configured to operate the vacuum work attachment either in a vacuum control mode or a rotate mode.

Suitably, in the rotate mode, a portion of the auxiliary hydraulic fluid is bled off and is used to allow the vacuum pump to continue running.

Suitably the controller selects rotate mode upon receipt of a suitable hydraulic signal. For example, the controller may be responsive to a predetermined sequence of hydraulic pulses to activate rotation mode. The rotator may then be operated as per conventional auxiliary hydraulic control.

In some embodiments, the hydraulic rotator has a two speed control valve function so that it can supply a greater flow of hydraulic fluid when the vacuum lift attachment is loaded when compared to the unloaded state.

It is desirable to be able to rotate an unloaded lift vacuum pad for the purposes of correct alignment with an object to be lifted and to correctly place a lifted object. Accordingly, rotate mode may be deactivated or deselected when a load is being engaged or disengaged. In this way, when rotate mode is disengaged, the signals received by the electronic controller are understood by the electronic controller to be actuation signals for vacuum control.

In the embodiment where the vacuum lift attachment includes a load sensor, suitably the electronic controller is configured to automatically disengage rotate mode when the load sensor is actuated.

Suitably, the electronic controller is battery powered. In this case, the vacuum lift attachment suitably includes an alternator that is driven by drive pulley operatively attached to the vacuum pump for charging the battery.

According to a further broad form of the disclosure, there is provided an electronic controller for controlling a vacuum lift attachment that is adapted to be coupled to a lifting arm of a hydraulic work machine for hydraulic fluid connection to an auxiliary hydraulic system of the work machine, the vacuum lift attachment including an hydraulic pump, at least one vacuum reservoir and a vacuum show and a sensor system;

the electronic controller being configured to receive hydraulic signals from the auxiliary hydraulic circuit and convert the hydraulic signal to electronic signals so as to electronically control at least one of the following actions, opening of an air valve so as to allow fluid communication between the vacuum reservoir and the vacuum pad, closing of an air valve so as to close any fluid communication between the vacuum pad and the at least one vacuum reservoir and the sensor system that includes at least one sensor for sensing when the vacuum has reached a predetermined operating level and a sensor for sensing when the vacuum level has fallen below a predetermined safety level.

In the embodiment in which the vacuum lift attachment includes a rotator, the electronic control is suitably configured to electronically control a flow of hydraulic fluid to the rotator so as to control the supply of hydraulic fluid to the rotator to activate the rotator and to control the rotation and speed thereof.

According to a further aspect, there is disclosed a vacuum lift attachment for a hydraulic work machine having a control station, a lift arm to which a hydraulic work attachment can be coupled; the vacuum lift attachment comprising:

a body having an upper end having connecting a pair of connecting pins for coupling to a quick hitch on the lifting arm of the hydraulic work machine;

a hydraulic rotator mounted to the lower end of the body; and a vacuum pad mounted to the hydraulic rotator for rotation relative to the body that is operable between a suction position and a release position.

According to a further broad aspect there is disclosed a vacuum lift attachment for lifting a load for a hydraulic work machine having, a lift arm to which the vacuum lift attachment can be coupled, the vacuum lift attachment comprising:

a body having an upper end that is adapted to be coupled to the lift arm of the hydraulic work machine;

a vacuum pad mounted to the lower end of the body;

a vacuum pump in fluid communication with a first service vacuum reservoir, an air valve operable between an open position in which the first service reservoir is in fluid communication with the vacuum pad so as to apply a vacuum thereto and a closed position; and a second reserve vacuum reservoir that is fluidly isolated from the vacuum pad when the vacuum pad is carrying a load at or above a predetermined vacuum level, and if the vacuum level falls below the predetermined level a second air valve is actuated to fluidly connect the reserve vacuum reservoir to the vacuum pad.

DETAILED DESCRIPTION OF THE FIGURES

Figure 1:
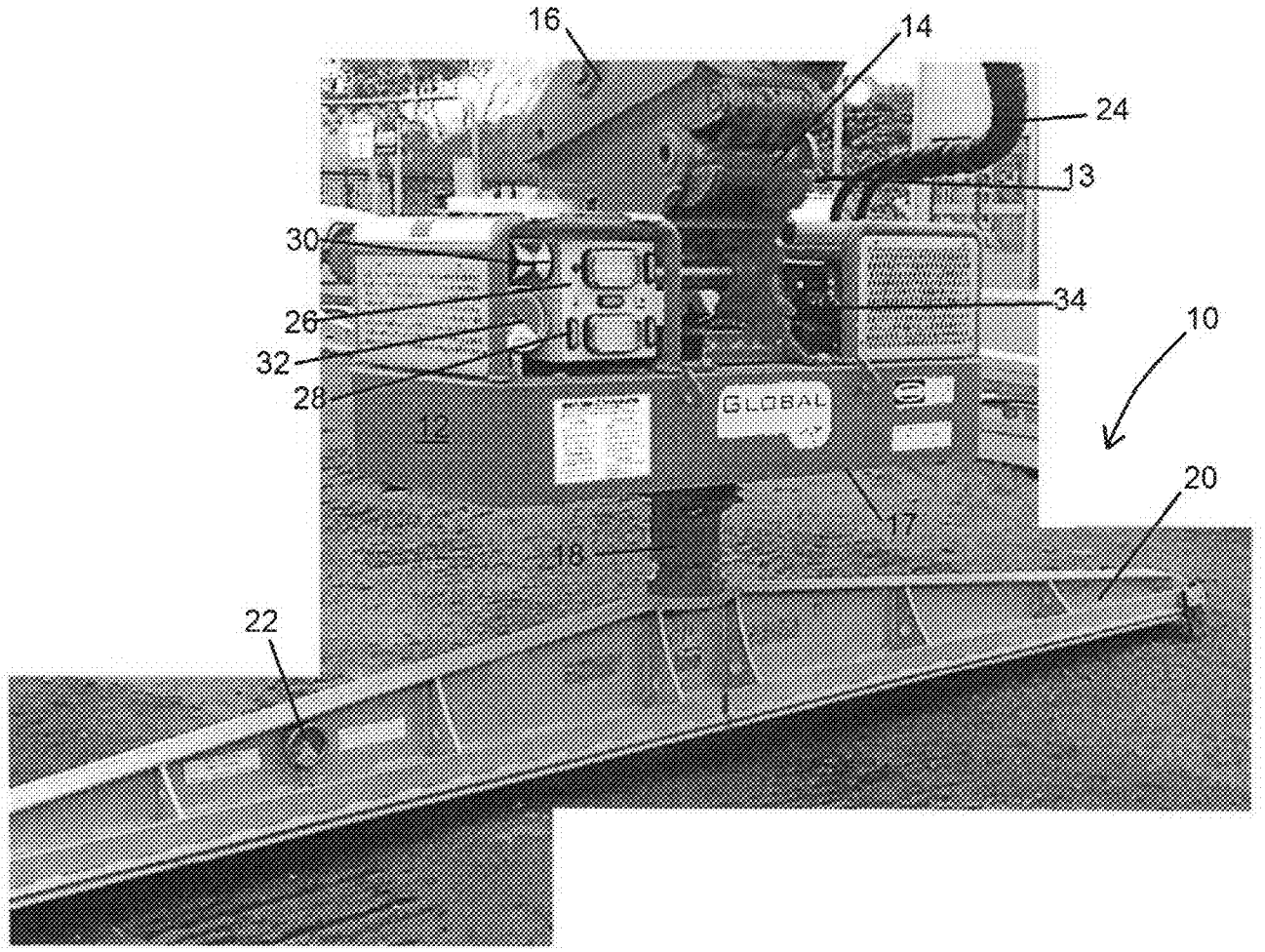
FIG. 1 is a perspective view of a vacuum lift apparatus according to one aspect of the present disclosure.

FIG. 1 shows a vacuum lift attachment 10 as disclosed herein. The vacuum lift attachment includes a body 12 having an upper end 13 and a lower end 17, connecting pins 14 on the upper end 13 of the body 12 for connection to a quick hitch 16. A rotator 18 is located on the bottom end of the body 12.

A vacuum pad 20 is mounted to the rotator 18. A vacuum pad pressure gauge 22 is located on the vacuum pad 20.

The vacuum lift attachment is hydraulically connected to the work machine through the auxiliary hydraulic fluid lines 24.

An electronic controller that is a PLC 26 is mounted on one side of the body 12. Signals 28 in the form of different coloured LED lights are located on the front of the PLC. The signals 28 are configured to be easily visible to an operator siting in the control station of an excavator. The signals 28 will be described in further detail below. Next to the signals 28 is a hydraulic fluid level indicator 30 and a vacuum gauge 32 showing the vacuum level in the service air tank or vacuum reservoir.

A hydraulic vacuum pump 34 is located on the other side of the body 12.

Figure 2:
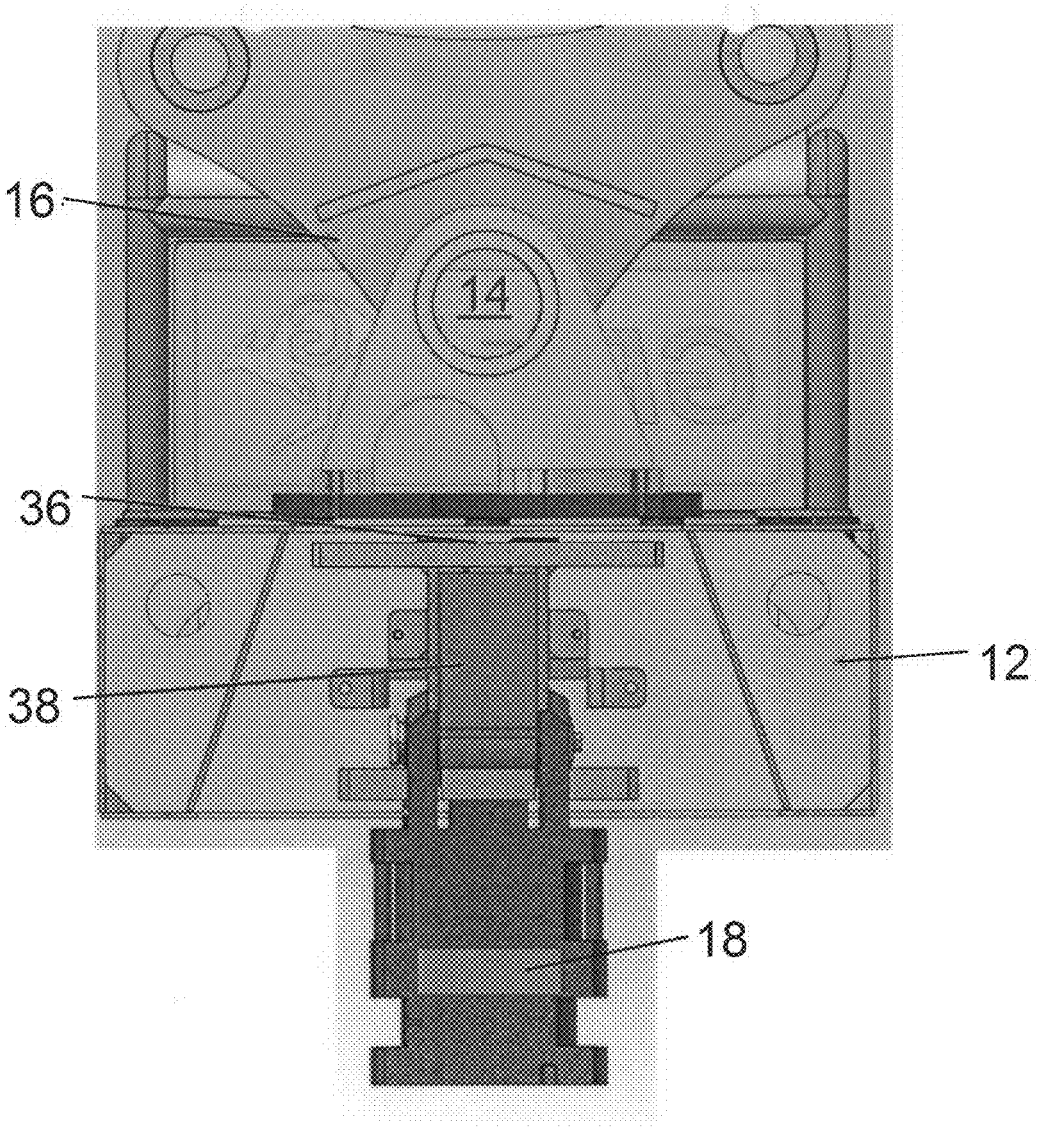
FIG. 2 is a schematic view of the vacuum lift attachment.

FIG. 2 is a schematic side view of the vacuum lift attachment 10. A load switch or sensor 36 is located at the upper end 13 of the body 12 and is mounted on a telescopic arm 38. In use, when the vacuum pad 20 is placed upon an object or load to be lifted, thereby applying a load to the vacuum pad 20, the telescopic arm 38 moves upward so as to activate the load sensor 36. When the vacuum pad 20 is lifted off the ground, either loaded or unloaded, the load sensor 36 will automatically deactivate.

Figure 3:
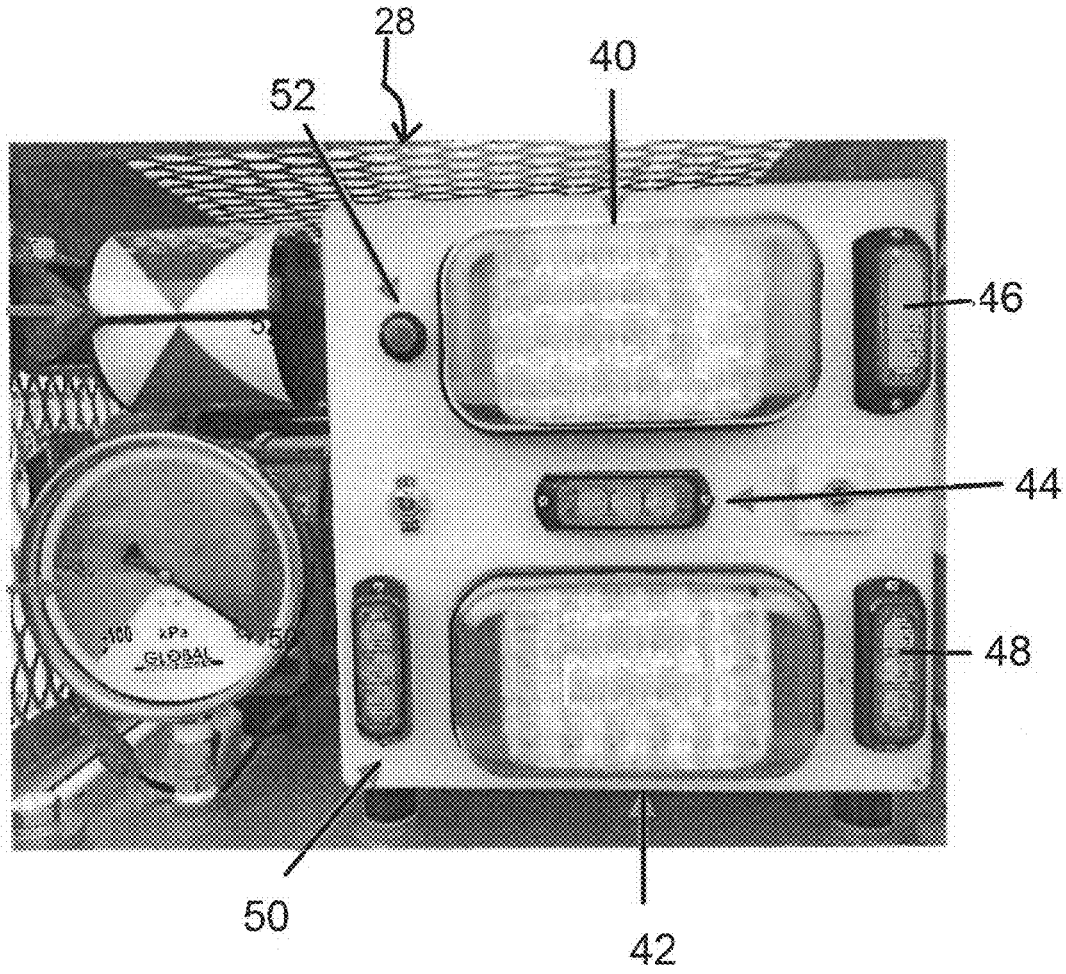
FIG. 3 is a detail of the signal box of the vacuum lift attachment.

FIG. 3 shows the signals 28 in detail. The signals include a green light 40. The PLC is configured to receive signals from a service tank vacuum sensor and cause the green vacuum light 40 to flash as the vacuum is increasing and to show a solid green light when the vacuum has reached the predetermined operating vacuum level.

A second red warning light 42 is located below green light 40. The PLC is configured to activate the red light when the vacuum level drops to a predetermined dangerous level. This signals to an operator to abort a lift immediately and lower a load safely to the ground.

A vacuum applied signal light 44 between the red 40 and 42 green lights will show blue when a vacuum is being applied.

The PLC is further configured to turn the light 46 on the upper right corner of the signals 28 to show amber when the load sensor 36 is activated, to turn the light 48 on the lower right corner to show amber when the auxiliary hydraulic fluid is being applied, to turn the light 50 on the lower left corner to show amber when the vacuum lift attachment 10 is in rotate mode (described below) and an alternator warning light 52 in the upper left corner.

Figure 4:
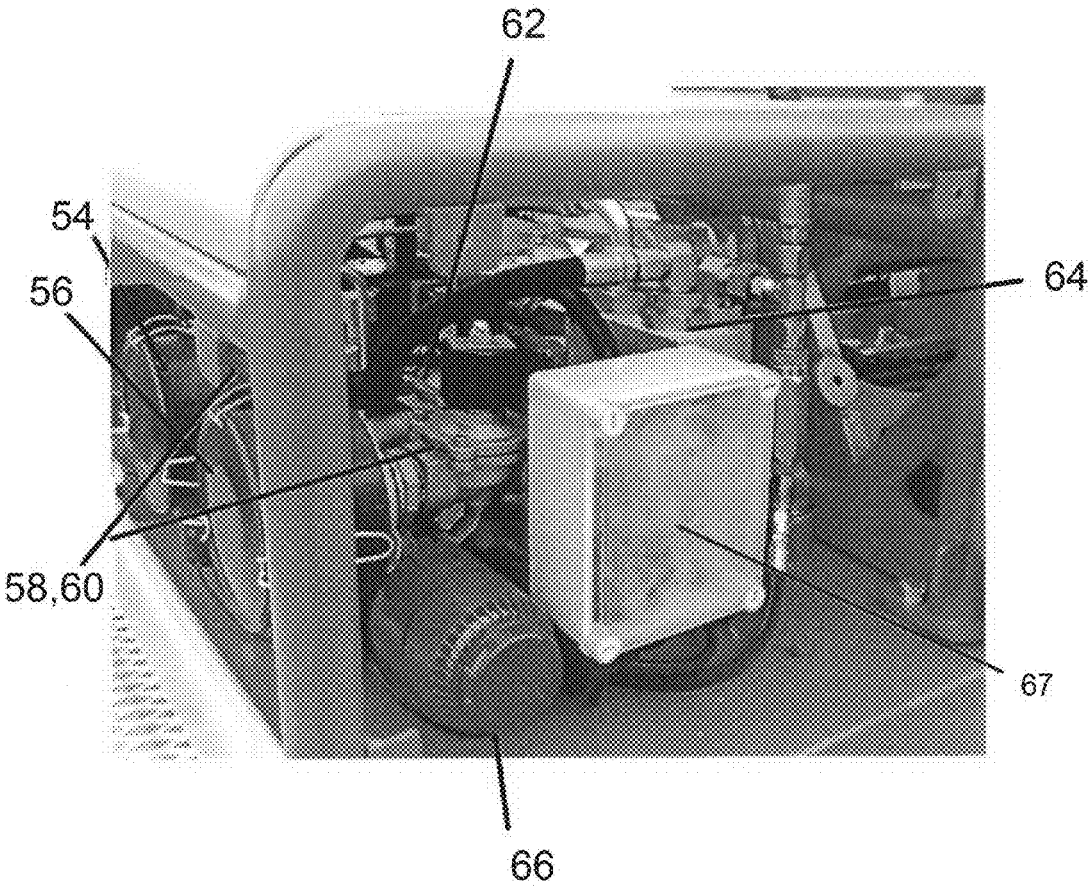
FIG. 4 is a view of part of the internal section of the body of the vacuum lift attachment.

FIG. 4 shows the arrangement of the inside of the body 12 showing the position of air filters 54, 56, air valves 58, 60 that are controlled by the PLC to open and close so as to apply and release vacuum to the vacuum pad 20; booster or emergency air valve 62 that allows fluid communication between the service and a reserve vacuum reservoirs in an emergency situation; junction box 67; a first hydraulic flow valve 64 that directs hydraulic flow to the hydraulic vacuum pump 34 and an emergency alarm 66 that alerts an operator to a low vacuum level.

Figure 5:
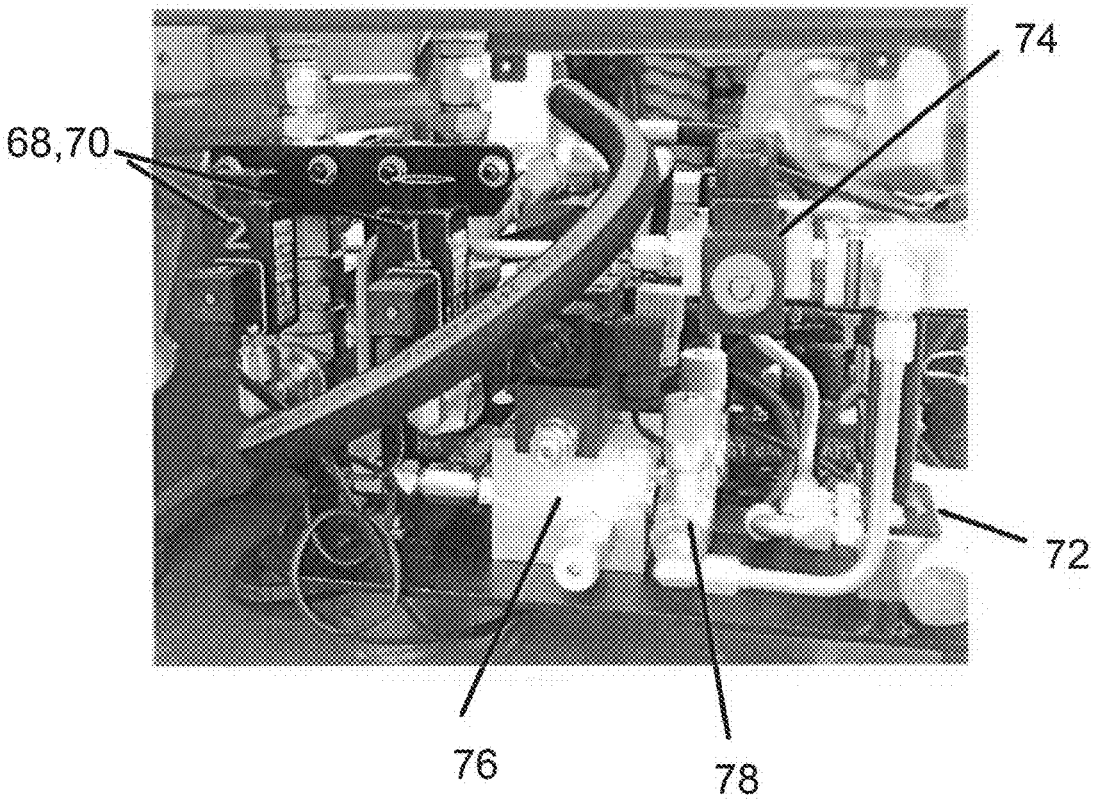
FIG. 5 shows another view of part of the internal section of the body of the vacuum lift attachment.

FIG. 5 shows the location of first and second hydraulic switches 68, 70 that convert the hydraulic signal to an electronic signal, a second hydraulic flow valve 72 that directs auxiliary hydraulic fluid to the rotator circuit that includes a rotator activation valve 74, a rotator direction valve 76 and a rotator speed valve 78.

The operation of the vacuum lift attachment (10) will now be described. The vacuum lift attachment 10 is mounted to the stick of an excavator by means of the quick hitch coupling (16) and the auxiliary hydraulic lines (24) connected as per conventional hydraulic coupling to a hydraulic tool.

When hydraulically attached, the auxiliary hydraulic fluid first enters a two stage or bidirectional flow reducer. The flow from the second stage always supplies the vacuum pump drive. The surplus from the second stage is directed to the rotator directional control valves.

The vacuum pump has an output drive pulley that is used to drive an automotive type alternator. The alternator charges an on board battery that provides power to the PLC.

The PLC remains dormant or in sleep mode until it is actuated in response to a hydraulic signal in the auxiliary hydraulic lines in response to actuation of the auxiliary hydraulic system by an operator using the excavator's auxiliary hydraulic actuator. The hydraulic signals are converted to electronic signals by means of electro hydraulic pressure switches.

The operator turns the vacuum on by applying the auxiliary hydraulics. The green vacuum signal light 42 flashes showing that the vacuum is increasing. When the vacuum has reached the predetermined operating level, the green light 42 will show a solid colour. When the auxiliary hydraulic system is being used to operate the vacuum pump it is known as vacuum mode.

When the vacuum has built up, the PLC can be actuated to convert the mode of operation from vacuum mode to rotate mode. This is typically done by the operator giving two quick auxiliary hydraulic pulses (within one second). Rotate mode is indicated by amber light 50 turning on. Rotate mode is automatically cancelled by the PLC after four seconds of inaction.

The hydraulic rotator 18 can then be operated according to conventional activation of the auxiliary hydraulic system actuator of the excavator. The vacuum pad 20 can be rotated, lifted and lowered over an object to be lifted.

The vacuum pad 20 is lowered until the load sensor 36 is activated. Activation of the load sensor 36 shows that the vacuum pad 20 is in a vacuum seal position on the object or load. Further, the PLC is configured so that activation of the load switch automatically cancels rotate mode and reverts to vacuum mode.

The operator can then apply a hydraulic signal to control the PLC to cause the air valve(s) that direct vacuum to the vacuum pad 20 to open, thereby applying a vacuum. When the air valve(s) is opened and a vacuum is applied the blue vacuum applied light 44 will light up. The auxiliary hydraulics activates the vacuum pump 34 to build the vacuum in the system to the predetermined operating level. When this has been reached the green light 40 shows solid green. The auxiliary hydraulics lever can then be released; the operator should check the vacuum pad gauge 22 to ensure the vacuum level is stable prior to lifting the load.

When the load is lifted the load sensor 36 will be deactivated. The PLC is configured to automatically allow rotate mode to be activated as desired by the operator. The PLC is also configured such that after the load sensor 36 has been deactivated signalling that the load has been lifted, it is not possible for an operator to release the vacuum so as to avoid inadvertently closing the air valve(s) causing dangerous releasing of the load.

In order to release the load, the vacuum lift attachment (10) and load are lowered to a ground surface until the load switch indicator light 46 illuminates. The auxiliary hydraulics are applied so as to release the vacuum from the vacuum pad 20 by causing the PLC to send an electronic signal to close the air valve so as to isolate the vacuum reservoir from the vacuum pad 20. When the air valve(s) close, the blue vacuum applied indicator light 46 will turn off. The operator should check that the vacuum pad gauge 22 reads zero before lifting away from the load.

After the vacuum lift attachment (10) has unloaded, it will automatically shut down after about 2 minutes of inaction.

It will be appreciated that the vacuum lift attachments as disclosed herein provide a number of advantages over current vacuum lift attachments. Further, the vacuum lift attachment can be controlled entirely from the work machine's existing hydraulic circuit, instead of a separate remote control or hard wired control. This makes operation much simpler. Further, the ability to use a quick hitch coupler has significant advantages in terms of productivity optimisation of machine time, costs and the like.

Providing the rotator below the body means that the body does not rotate. This ensures that the signals 28 are always in the same place relative to the work station for easy view by an operator. Further, the auxiliary hydraulic lines are connected to the body in a fixed manner and there is no need to worry about the hydraulic connections being damaged during rotation (this is a common problem with hydraulic rotators).

The vacuum pump has a "vacuum on demand" capability that can extend pump life, is quieter, and uses less fuel and less pollution.

It will be appreciated that various changes and modifications may be made to the present invention as disclosed and claimed herein without departing from the spirit and scope thereof.

The invention claimed is:

1. A vacuum lift attachment for a hydraulic work machine, the hydraulic work machine including a control station, a lift arm to which the hydraulic work attachment can be coupled, an auxiliary hydraulic system for operating a coupled hydraulic work attachment and an auxiliary hydraulic actuator in the control station that upon actuation by an operator causes an auxiliary hydraulic control signal to generate, wherein the vacuum lift attachment comprises:

a body having an upper end that is adapted to be coupled to the lift arm of the hydraulic work machine and for hydraulic fluid connection to the auxiliary hydraulic system of the hydraulic work machine;

a vacuum pad operatively mounted to the lower end of the body;

a hydraulic vacuum pump fluidly connected to the auxiliary hydraulic system;

an electronic controller that is configured to receive an auxiliary hydraulic control signal and convert the auxiliary hydraulic control signal to an electronic signal for electronic control of the vacuum lift attachment by an operator actuating the auxiliary hydraulic actuator in the control station; and a hydraulic rotator mounted to the lower end of the body and between the body and the vacuum pad and the hydraulic rotator has a two speed control valve function so that it can supply a greater flow of hydraulic fluid when the vacuum lift attachment is loaded when compared to the unloaded state.

2. The vacuum lift attachment of claim 1, wherein the vacuum lift attachment includes a bidirectional valve system for splitting the auxiliary hydraulic fluid flow into a first stream that drives and controls the hydraulic vacuum pump and a second stream for operation of the hydraulic rotator.

3. The vacuum lift attachment of claim 1, wherein the vacuum lift attachment comprises a vacuum reservoir in fluid communication with the vacuum pad, in which the fluid communication is controlled by at least one air valve operable between an open position and a closed positions so as to apply and close a supply of vacuum to the vacuum pad.

4. The vacuum lift attachment of claim 3, wherein the vacuum reservoir includes a first service reservoir and a second reserve reservoir and the second reserve vacuum reservoir is fluidly isolated from the vacuum pad when the vacuum pad is carrying a load at or above a predetermined safe vacuum level, and if the vacuum level falls below the predetermined safe vacuum level a second air valve is actuated to fluidly connect the reserve vacuum reservoir to the vacuum pad.

5. The vacuum lift attachment of claim 1, wherein the electronic controller is a programmable logic controller (PLC).

6. The vacuum lift attachment of claim 5, wherein the electronic controller is configured to remain in a sleep mode until an auxiliary hydraulic control signal is detected by the electronic controller and the electronic controller is activated to an operative mode.

7. The vacuum lift attachment of claim 6, wherein the electronic controller is further configured to operate the vacuum work attachment either in a vacuum control mode or a rotate mode.

8. The vacuum lift attachment of claim 7, wherein when the auxiliary hydraulic actuator is activated by an operator to cause a flow of auxiliary hydraulic fluid to the hydraulic vacuum pump, the hydraulic vacuum pump builds up a vacuum until it reaches a predetermined operating level.

9. The vacuum lift attachment of claim 8, wherein the vacuum lift attachment further includes a vacuum sensor operatively connected to a vacuum gauge that is configured to produce an audio and/or visual signal that can be seen and/or heard by an operator in the control station of the work machine to indicate when the vacuum has reached the predetermined operating level.

10. The vacuum lift attachment of claim 9, wherein the vacuum lift attachment further includes a load sensor that is activated when the vacuum pad has contacted a load to be lifted and causes activation of an audio and/or visual signal that can be seen and/or heard by the operator in the control station.

11. The vacuum lift attachment of claim 10, wherein the electronic controller is configured to automatically disengage rotate mode when the load sensor is activated.

12. The vacuum lift attachment of claim 11, wherein when the vacuum is being applied to the load to be lifted, an audio and/or visual signal is generated so as to confirm to the operator that vacuum is being applied and a further signal is generated when there is sufficient vacuum applied to lift the object.

13. The vacuum lift attachment of claim 12, wherein when the load is lifted, the load sensor is deactivated and the electronic controller is configured to receive a signal that the load sensor is deactivated and prevents inadvertent operator release of the applied vacuum.

14. The vacuum lift attachment of claim 1, wherein the electronic controller is battery powered and the vacuum lift attachment includes an alternator that is driven by a drive pulley operatively attached to the vacuum pump for charging the battery.

15. The vacuum lift attachment of claim 1, wherein the vacuum lift attachment further comprises at least one vacuum reservoir in fluid communication with the vacuum pad and at least one air valve that can be opened and closed so as to control fluid communication between the vacuum reservoir and the vacuum pad, wherein the electronic controller is configured to control at least one of the following actions: opening of the at least one air valve, closing of the at least one air valve, and to comprise a sensor system that includes at least one sensor for sensing when the vacuum in the at least one vacuum reservoir has reached a predetermined operating level and a sensor for sensing when the vacuum level has fallen below a predetermined safety level.

16. The vacuum lift attachment of claim 15, wherein the vacuum lift attachment includes a rotator and the electronic controller is configured to electronically control a flow of hydraulic fluid to the rotator so as to control the supply of hydraulic fluid to the rotator to activate the rotator and to control the rotation and speed thereof.

17. A vacuum lift attachment for a hydraulic work machine having a lift arm to which the vacuum lift attachment can be coupled, the vacuum lift attachment comprising:

a body having an upper end that is adapted to be coupled to the lift arm of the hydraulic work machine;

a vacuum pad mounted to the lower end of the body;

a vacuum pump in fluid communication with a first service vacuum reservoir;

an air valve operable between an open position in which the first service reservoir is in fluid communication with the vacuum pad so as to apply a vacuum thereto and a closed position; and a second reserve vacuum reservoir that is fluidly isolated from the vacuum pad when the vacuum pad is carrying a load at or above a predetermined vacuum level, and if the vacuum level falls below the predetermined level a second air valve is actuated to fluidly connect the reserve vacuum reservoir to the vacuum pad.

18. The vacuum lift attachment of claim 17, wherein the vacuum lift attachment further comprises a hydraulic rotator mounted to the lower end of the body and between the body and the vacuum pad.

19. A vacuum lift attachment for a hydraulic work machine, the hydraulic work machine including a control station, a lift arm to which the hydraulic work attachment can be coupled, an auxiliary hydraulic system for operating a coupled hydraulic work attachment and an auxiliary hydraulic actuator in the control station that upon actuation by an operator causes an auxiliary hydraulic control signal to generate; wherein the vacuum lift attachment comprises:

a body having an upper end that is adapted to be coupled to the lift arm of the hydraulic work machine and for hydraulic fluid connection to the auxiliary hydraulic system of the hydraulic work machine;

a vacuum pad operatively mounted to the lower end of the body;

a hydraulic vacuum pump fluidly connected to the auxiliary hydraulic system;

an electronic controller that is configured to receive an auxiliary hydraulic control signal and convert the auxiliary hydraulic control signal to an electronic signal for electronic control of the vacuum lift attachment by an operator actuating the auxiliary hydraulic actuator in the control station; and a vacuum reservoir in fluid communication with the vacuum pad, in which the fluid communication is controlled by at least one air valve operable between an open and a closed positions so as to apply and close a supply of vacuum to the vacuum pad, wherein the vacuum reservoir includes a first service reservoir and a second reserve reservoir, wherein the second reserve vacuum reservoir is fluidly isolated from the vacuum pad when the vacuum pad is carrying a load at or above a predetermined safe vacuum level, and wherein if the vacuum level falls below the predetermined safe vacuum level a second air valve is actuated to fluidly connect the reserve vacuum reservoir to the vacuum pad.

20. The vacuum lift attachment of claim 19, wherein the vacuum lift attachment further includes a load sensor that is activated when the vacuum pad has contacted a load to be lifted and causes activation of an audio and/or visual signal that can be seen and/or heard by the operator in the control station.

* * * * *